US011063339B2

(12) United States Patent
Wu et al.

(10) Patent No.: US 11,063,339 B2
(45) Date of Patent: Jul. 13, 2021

(54) ANTENNA MODULE AND COMMUNICATION DEVICE

(71) Applicant: PEGATRON CORPORATION, Taipei (TW)

(72) Inventors: Chien-Yi Wu, Taipei (TW); Cheng-Hsiung Wu, Taipei (TW); Chao-Hsu Wu, Taipei (TW); Ching-Hsiang Ko, Taipei (TW); Shih-Keng Huang, Taipei (TW); Yu-Yi Chu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 6 days.

(21) Appl. No.: 16/502,209

(22) Filed: Jul. 3, 2019

(65) Prior Publication Data

US 2020/0112080 A1 Apr. 9, 2020

(30) Foreign Application Priority Data

May 30, 2018 (TW) ..... 107118548

(51) Int. Cl.
*H01Q 1/22* (2006.01)
*H01Q 1/24* (2006.01)
(Continued)

(52) U.S. Cl.
CPC ..... *H01Q 1/2266* (2013.01); *H01Q 1/24* (2013.01); *H01Q 5/357* (2015.01); *H01Q 5/50* (2015.01); *H01Q 13/106* (2013.01)

(58) Field of Classification Search
CPC ..... H01Q 1/2266; H01Q 1/24; H01Q 1/48; H01Q 1/2258; H01Q 1/44; H01Q 1/36;
(Continued)

(56) References Cited

U.S. PATENT DOCUMENTS 8,059,039 B2 11/2011 Vazquez et al.
9,318,793 B2 4/2016 Zhu et al.
(Continued)

FOREIGN PATENT DOCUMENTS

TW 201705610 A 2/2017
TW 201721972 A 6/2017
TW 201735444 A 10/2017

*Primary Examiner* — Awat M Salih
(74) *Attorney, Agent, or Firm* — McClure, Qualey & Rodack, LLP

(57) ABSTRACT

An antenna module includes a metal board, an inverted F metal plate and an antenna unit. A slot is provided between the inverted F metal plate and the metal board, the inverted F metal plate and the metal board are integrally formed, and the inverted F metal plate is disposed perpendicular to the metal board. The antenna unit is disposed corresponding to the slot and the inverted F metal plate, and includes a radiation part and a ground part. The radiation part is coupled to a signal feeding point and includes a first radiation body and a second radiation body. The first radiation body, the slot and the inverted F metal plate operate cooperatively to generate a wireless signal at a first operating frequency. The second radiation body, the slot and the inverted F metal plate operate cooperatively to generate a wireless signal at a second operating frequency.

10 Claims, 7 Drawing Sheets

(51) Int. Cl.
*H01Q 5/50* (2015.01)
*H01Q 5/357* (2015.01)
*H01Q 13/10* (2006.01)

(58) Field of Classification Search
CPC .. H01Q 1/38; H01Q 1/50; H01Q 5/50; H01Q 5/357; H01Q 5/20; H01Q 5/364; H01Q 13/10
See application file for complete search history.

(56) References Cited

U.S. PATENT DOCUMENTS

| | | | | |
|---|---|---|---|---|
| 9,929,473 | B2 | 3/2018 | Huang et al. | |
| 10,038,249 | B2 | 7/2018 | Lo et al. | |
| 2009/0184876 | A1* | 7/2009 | Liu | H01Q 1/38 343/700 MS |
| 2015/0255853 | A1 | 9/2015 | Kwong et al. | |
| 2017/0141465 | A1* | 5/2017 | Sharawi | H01Q 21/28 |

* cited by examiner

ANTENNA MODULE AND COMMUNICATION DEVICE

CROSS-REFERENCE TO RELATED APPLICATION

This application claims the priority benefit of Taiwan application serial no. 107118548, filed on May 30, 2018. The entirety of the above-mentioned patent application is hereby incorporated by reference herein and made a part of this specification.

BACKGROUND OF THE INVENTION

Field of Invention

The disclosure relates to an antenna module, and particularly relates to an antenna module capable of being disposed in a narrow frame.

Description of Related Art

With the development of laptop computers, people have increasing demands for a higher screen ratio. Due to an excessive area taken up by a conventional closed-slot antenna above the screen of a laptop computer, the conventional closed-slot antenna can no longer satisfy the demands on aesthetics and structural strength.

Therefore, how to design an antenna module capable of normally transmitting and receiving wireless signals while having a high screen ratio has become an issue in this field.

SUMMARY

An aspect of the disclosure provides an antenna module. The antenna module includes a metal board, an inverted F metal plate and an antenna unit. A slot is provided between the inverted F metal plate and the metal board, the inverted F metal plate and the metal board are integrally formed, and the inverted F metal plate is disposed perpendicular to the metal board. The antenna unit is disposed corresponding to the slot and the inverted F metal plate and the antenna unit includes a radiation part and a ground part. The radiation part is coupled to a signal feeding point and includes a first radiation body and a second radiation body. The first radiation body, the slot and the inverted F metal plate operate cooperatively to generate a wireless signal at a first operating frequency. The second radiation body, the slot and the inverted F metal plate operate cooperatively to generate a wireless signal at a second operating frequency.

Another aspect of the disclosure provides a communication device. The communication device includes a metal board, an inverted F metal plate, a first antenna unit, and a second antenna unit. A first slot and a second slot are provided between the inverted F metal plate and the metal board, the inverted F metal plate and the metal board are integrally formed, and the inverted F metal plate is disposed perpendicular to the metal plate. The first antenna unit is disposed in correspondence with the first slot and the inverted F metal plate, and the first antenna unit includes a first radiation body and a second radiation body. The second antenna unit is disposed in correspondence with the slot and the inverted F metal plate, has a gap with respect to the first antenna unit, and the second antenna unit includes a third radiation body and a fourth radiation body. The first radiation body, the first slot, and the inverted F metal plate operate cooperatively to generate a wireless signal at a first operating frequency. The second radiation body, the first slot, and the inverted F metal plate operate cooperatively to generate a wireless signal at a second operating frequency. The third radiation body, the second slot, and the inverted F metal plate operate cooperatively to generate a wireless signal at the first operating frequency. The fourth radiation body, the second slot, and the inverted F metal plate operate cooperatively to generate a wireless signal at the second operating frequency.

Therefore, according to the technical aspects of the disclosure, the dual frequency antenna with dual open-loop design for a narrow metal frame is provided in the embodiments of the disclosure by cooperative operation of the inverted F metal plate additionally disposed on the narrow frame with the pattern on the antenna unit as well as adjustment of the antenna impedance matching through the inverted U grounding configuration.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

In order to make the above and other objects, features and advantages of the disclosure more comprehensible, several embodiments accompanied with figures are described in detail below.

DETAILED DESCRIPTION

Figure 1A:
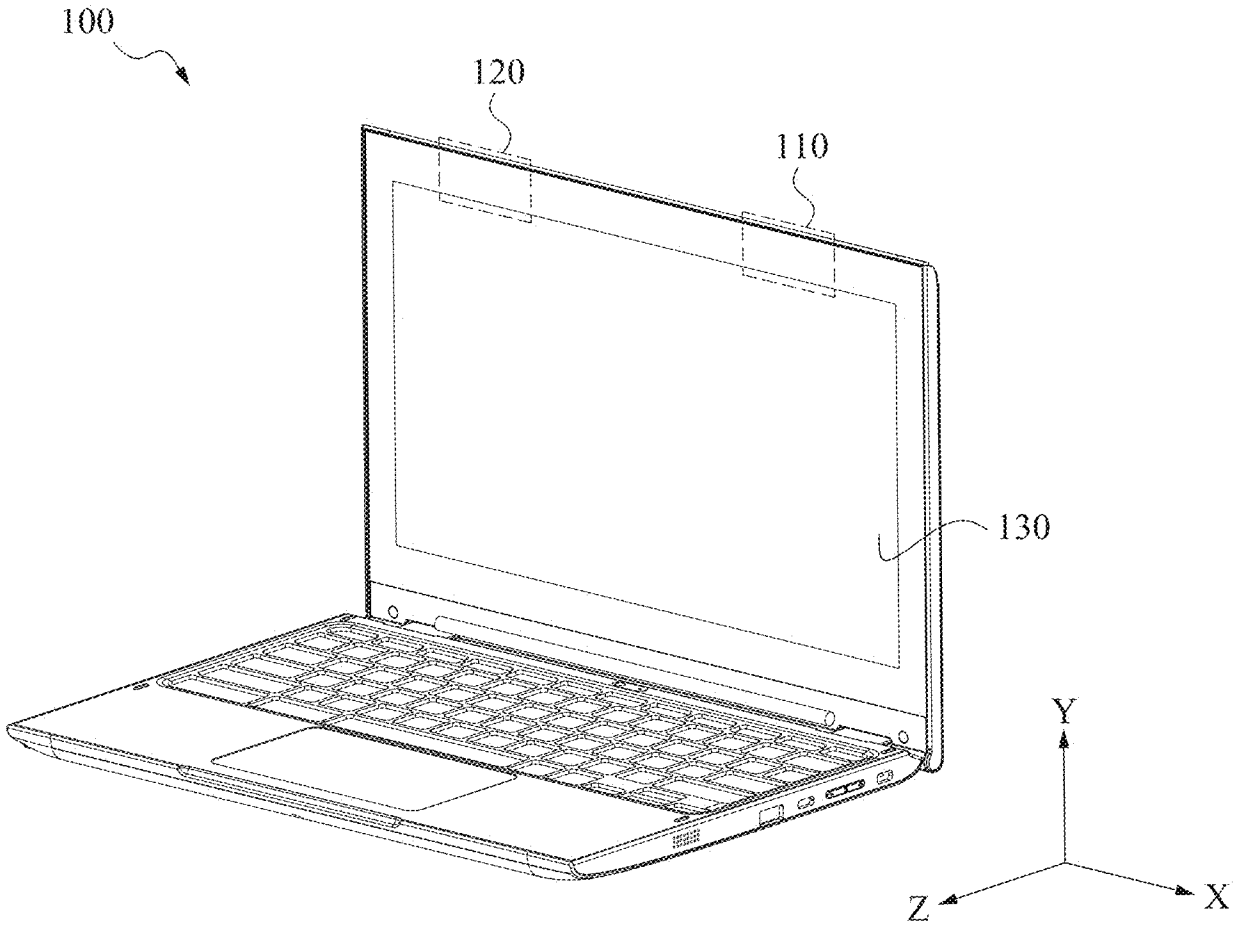
FIG. 1A is a schematic perspective front view illustrating a communication device according to some embodiments of the disclosure.

Reference will now be made in detail to the present preferred embodiments of the disclosure, examples of which are illustrated in the accompanying drawings. Wherever possible, the same reference numbers are used in the drawings and the description to refer to the same or like parts.

To comprehensively describe the disclosure in detail, reference may be made to the accompanying drawings and various embodiments. Meanwhile, components and steps known by the public are not described in the embodiments to prevent unnecessary limitations from being imposed to the disclosure.

Terms such as "couple" or "connect" used in the embodiments may refer to two or more components being in physical or electrical contact with each other "directly", two or more components being in physical or electrical contact with each other "indirectly", or acting of two or more components with each other.

The objective of the disclosure is to disclose an antenna unit capable of being disposed in a narrow frame of a communication device, so that the communication device still have a dual frequency and dual open-loop antenna design with isolation below the standard of −20 dB under the premise of reducing the size of the antenna unit.

FIG. 1A is a schematic perspective front view illustrating a communication device 100 according to some embodiments of the disclosure. As shown in FIG. 1A, in some embodiments, the front side of the communication device 100 includes a screen 130 as well as an antenna module 110 and an antenna module 120 disposed above the screen 130 (in the +Y direction). In addition, the antenna module 110 and the antenna module 120 are spaced apart from each other by a predetermined distance. In some embodiments, for better isolation, the antenna module 110 and the antenna module 120 are spaced apart by a distance greater than 12 cm.

In some embodiments, the antenna module 110 serves as a main antenna of the communication device 100, and the antenna module 120 serves as an auxiliary antenna of the communication device 100. In addition, each of the antenna modules 110 and 120 generate both 2.4 GHz and 5 GHz wireless signals, but the disclosure is not limited thereto. The antenna modules 110 and 120 may generate wireless signals at arbitrary frequencies.

In some embodiments, the communication device 100 may include a tablet computer, a personal computer (PC), or a laptop computer, but the disclosure is not limited thereto. Any electronic device having a communication function while required to narrow the frame to for a higher screen ratio falls within the scope of the disclosure. In the following, descriptions are made by using a laptop computer as an example.

Figure 1B:
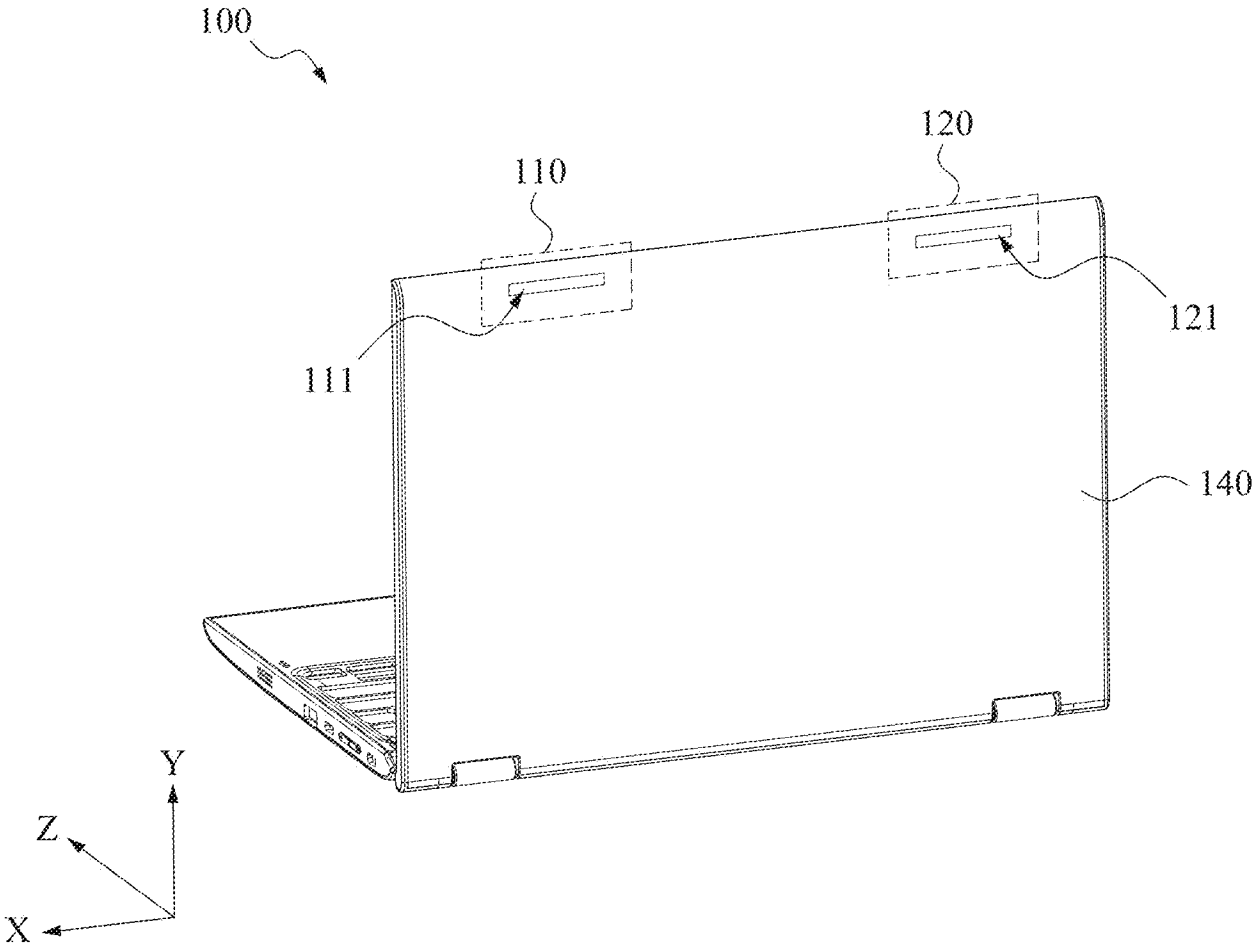
FIG. 1B is a schematic perspective rear view illustrating a communication device according to some embodiments of the disclosure.

FIG. 1B is a schematic perspective rear view illustrating a communication device 100 according to some embodiments of the disclosure. In some embodiments, as shown in FIG. 1B, the communication device 100 includes a metal board 140, and the metal board 140 has a slot 111 and a slot 121 corresponding to the antenna module 110 and the antenna module 120, respectively.

In some embodiments, the slots 111 and 112 allow wireless signals to pass through, and may be realized as through holes or apertures penetrating through the metal board 140.

In some embodiments, the antenna module 110 and the antenna module 120 have the same structure and only differ in being disposed at opposite positions. Therefore, in the following embodiments, the antenna module 110 is described as an example.

Figure 2:
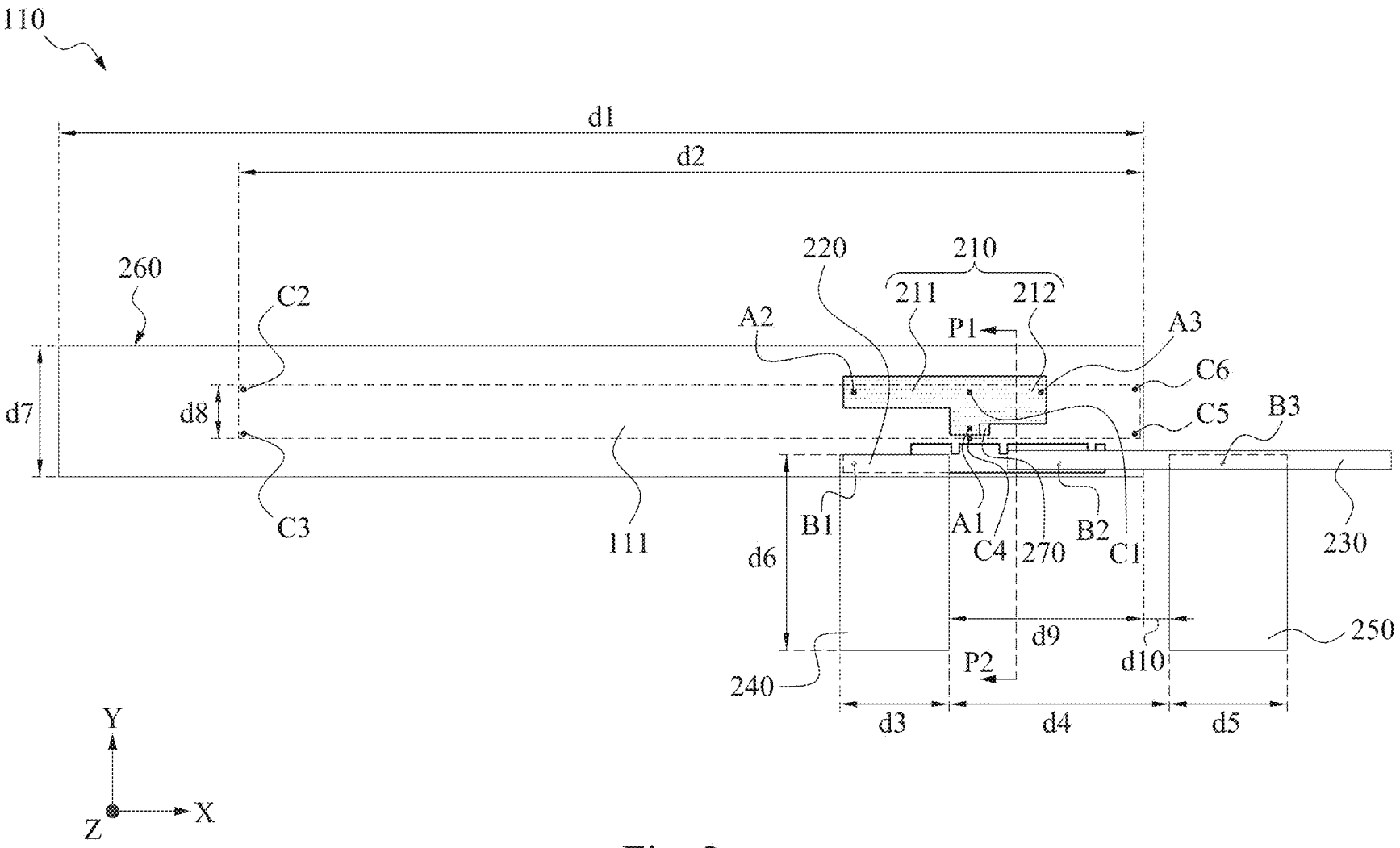
FIG. 2 is a schematic structure view illustrating an antenna module on the X-Y plane according to some embodiments of the disclosure.

FIG. 2 is a schematic structure view illustrating the antenna module 110 on the X-Y plane according to some embodiments of the disclosure. As shown in FIG. 2, the antenna module 110 includes the slot 111, an antenna unit 260, and a signal transmission line 230. The signal transmission line 230 is coupled to the antenna unit 260, and provides an electrical signal to the antenna unit 260, so that the antenna unit 260 may generate a wireless signal according to the electrical signal and transmit the wireless signal to an access point (AP) or a base station.

In some embodiments, the length of the antenna unit 260 in the X direction is defined as a distance d1, and the length of the antenna unit 260 in the Y direction is defined as a distance d7. The distance d1 may be 56 mm, and the distance d7 may be 6.85 mm, but the disclosure is not limited thereto.

In some embodiments, the antenna unit 260 may be realized as a printed circuit board (PCB).

In some embodiments, the length of the slot 111 in the X direction is defined as a distance d2, and the length of the slot 111 in the Y direction is defined as a distance d8. The distance d2 may be 46 mm, and the distance d8 may be 2.5 mm, but the disclosure is not limited thereto.

In some embodiments, the antenna unit 260 is disposed in correspondence with the slot 111. More specifically, the antenna unit 260 and the slot 111 are partially overlapping, for example, being overlapped 2.5 mm with each other in the Y direction.

In some embodiments, the antenna unit 260 includes a radiation part 210 and a ground part 220, and a gap exists between the radiation part 210 and the ground part 220. In some embodiments, the radiation part 210 is T-shaped, the lower end of the radiation part 210 is close to the ground part 220, and the lower part of the radiation part 210 is overlapped with the slot 111. For example, with the Y direction as the reference direction, the lower part of the radiation part 210 and the slot 111 are overlapped 2.5 mm. The radiation part 210 includes a radiation body 211, a radiation body 212, and a signal feeding point 270. The signal feeding point 270 is at the lowest point of the radiation part 210 in the Y direction, and the length of the radiation body 211 in the Y direction is smaller than the length of the radiation body 212 in the Y direction.

In some embodiments, the impedance matching of the antenna with dual frequency bands may be adjusted by adjusting the areas of the radiation body 211 and the radiation body 212.

In some embodiments, the radiation body 211, the slot 111, and an inverted F metal plate (i.e., 310 shown in FIG. 3, which is disposed in the Z direction of the antenna module 110 and will be described in greater detail in the following with reference to FIG. 3) operate cooperatively, so that the radiation body 211, the slot 111, and the inverted F metal plate may jointly form a first electrical path, and generate a resonance frequency band at a first operating frequency (e.g., 2.4 GHz) according to the first electrical path. The first electrical path is a path formed by nodes A1, A2, C1, C2, and C3 to C4. In other words, the antenna module 110 generates a wireless signal at the first operating frequency through the cooperative operation of the radiation body 211, the slot 111, and the inverted F metal plate (e.g., the inverted F metal plate 310 shown in FIG. 3).

In some embodiments, the length of the first electrical path (i.e., the nodes A1, A2, C1, C2, and C3 to C4) is ½ to ¾ times of the wavelength of the first operating frequency. However, the disclosure is not limited thereto. A length within a range from ½ times to ¾ times of the wavelength also falls within the scope of the disclosure. For example, if the first operating frequency is 2.4 GHz, the length of the first electrical path is in a range from 62 mm to 93 mm.

In some embodiments, the radiation body 212, the slot 111, and an inverted F metal plate (e.g., the inverted F metal plate 310 shown in FIG. 3) operate cooperatively, so that the radiation body 212, the slot 111, and the inverted F metal plate (e.g., the inverted F metal plate 310 shown in FIG. 3) may jointly form a second electrical path, and generate a resonance frequency band at a second operating frequency (e.g., 5 GHz) according to the second electrical path. The second electrical path is a path formed by nodes A1, A3, C1, C6, and C5 to C4. In other words, the antenna module 110 generates a wireless signal at the second operating frequency through the cooperative operation of the radiation body 212, the slot 111, and the inverted F metal plate (e.g., the inverted F metal plate 310 shown in FIG. 3).

In some embodiments, the length of the second electrical path (i.e., the nodes A1, A3, C1, C6, and C5 to C4) is ½ to ¾ times of the wavelength of the second operating frequency. However, the disclosure is not limited thereto. A length within a range from ½ times to ¾ times of the wavelength also falls within the scope of the disclosure. For example, if the second operating frequency is 5 GHz, the length of the second electrical path is in a range from 30 mm to 45 mm.

With the configuration, the antenna module 110 may generate a low-frequency resonance frequency band through the first electrical path (i.e., the nodes A1, A2, C1, C2, and C3 to C4), and generate a high-frequency resonance frequency band through the second electrical path (i.e., the nodes A1, A3, C1, C6, and C5 to C4), thereby constituting a dual frequency antenna with dual open-loop.

In some embodiments, the signal transmission line 230 includes a positive end and a negative end. The positive end of the signal transmission line 230 is coupled to the signal feeding point 270 and serves to transmit an electrical signal from the signal feeding point 270 to the radiation body 212, and the negative end of the signal transmission line 230 is grounded by being connected to a portion of a metal conductor 250 corresponding to a node B3. In some embodiments, the signal transmission line 230 includes an inner loop and an outer loop. The inner loop and the outer loop are separated by an insulating material. The inner loop is the positive end of the signal transmission line 230, and the outer loop is the negative end of the signal transmission line 230. When the negative end of the signal transmission line 230 is to be grounded, a PE or PVC outer jacket of the signal transmission line 230 is firstly peeled off, and the signal transmission line 230 is covered by a conductive tape (i.e., the metal conductor 250), so as to be grounded.

In some embodiments, the signal transmission line 230 may be realized by a 1.13 coaxial cable. The length of the signal transmission line 230 corresponding to the antenna module 110 is 350 mm, and the length of the signal transmission line corresponding to the antenna module 120 is 550 mm.

In some embodiments, the size of the metal conductor 250 in the Y direction is defined as a distance d6, and the size of the metal conductor 250 in the X direction is defined as a distance d5. The distance d6 may be 17 mm, and the distance d5 is in a range from 5 mm to 9 mm, but the disclosure is not limited thereto. In some embodiments, the metal conductor 250 may be realized by a conductive tape, but the disclosure is not limited thereto. Any metal conductor suitable for grounding falls within the scope of the disclosure.

In some embodiments, the ground part 220 includes a first portion corresponding to a node B1 and a second portion corresponding to a node B2. The first portion of the ground part 220 is grounded through a metal conductor 240, and the second portion of the ground part 220 is coupled to the positive end of the signal transmission line 230.

In some embodiment, the length of the metal conductor 240 in the Y direction is defined as the distance d6, and the length of the metal conductor 240 in the X direction is defined as a distance d3. The distance d6 may be 17 mm, and the distance d3 may be 5.5 mm, but the disclosure is not limited thereto. In some embodiments, the metal conductor 240 may be realized by a copper foil, but the disclosure is not limited thereto. Any metal conductor suitable for grounding falls within the scope of the disclosure.

In some embodiments, the ground part 220 and the signal transmission line 230 are connected in the X direction. The metal conductor 240 extends from one end of the ground part 220 along the −Y direction, and the metal conductor 250 extends from the signal transmission line 230 along the −Y direction. The metal conductor 240 and the metal conductor 250 are spaced apart by a distance d4, and the distance d4 therebetween is a range from 5 to 11 mm. Specifically, the distance d4 includes a distance d9 from the metal conductor 240 to the edge of the slot 111 and a distance d10 from the edge of the slot 111 to the metal conductor 250. The distance d9 is in a range from 5 to 10 mm, and the distance d10 is about 1 mm.

With the aforementioned configuration, the ground part 220, the signal transmission line 230, the metal conductor 240, and the metal conductor 250 may form an inverted U grounding configuration. With the inverted U grounding design (i.e., changing the distance d4 between the metal conductor 240 and the metal conductor 250) and the size of the radiation part 210, the impedance matching of the antenna may be properly adjusted for the antenna module 110.

Figure 3:
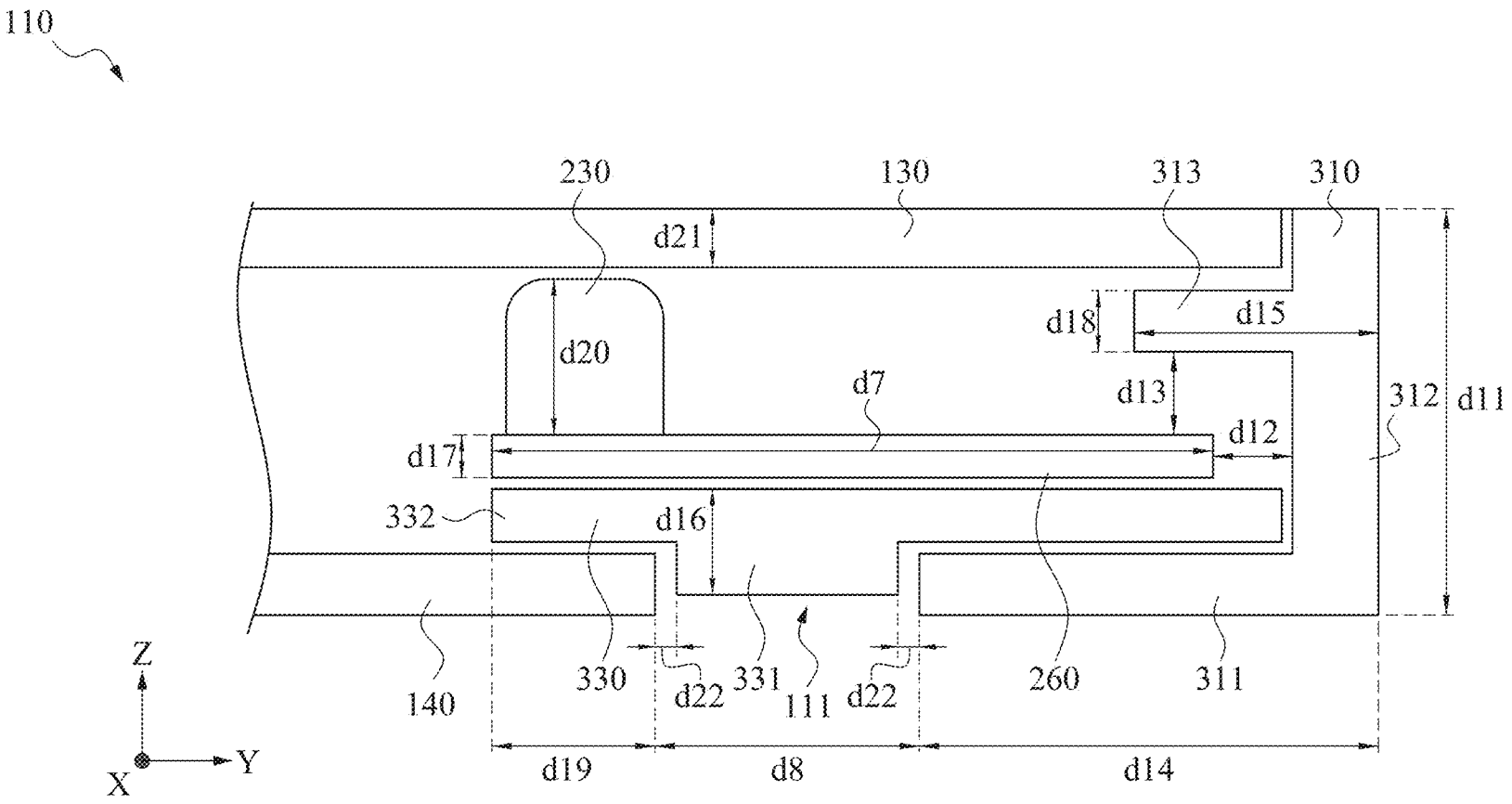
FIG. 3 is a schematic cross-sectional view illustrating an antenna module along a sectional line P1-P2 according to some embodiments of the disclosure.

FIG. 3 is a schematic cross-sectional view illustrating the antenna module 110 that is cut open along a sectional line P1-P2 shown in FIG. 2 according to some embodiments of the disclosure. As shown in FIG. 3, in addition to the screen 130 shown in FIG. 1A, the metal board 140 shown in FIG. 1B, and the slot 111, the antenna unit 260, and the signal transmission line 230 shown in FIG. 2, the antenna module 110 further includes the inverted F metal plate 310 and an insulating board 330. With the +Z direction as the reference direction, the insulating board 330 is disposed above the metal board 140 and the inverted F metal plate 310, the antenna unit 260 is disposed above the insulating board 330, the signal transmission line 230 is disposed above the antenna unit 260, and the screen 130 is disposed above the signal transmission line 230.

As shown in FIG. 3, the inverted F metal plate 310 is disposed perpendicular to the metal board 140, the slot 111 is disposed between the metal board 140 and the inverted F metal plate 310. In addition, the antenna unit 260 is disposed in correspondence with the slot 111 and the inverted F metal plate 310. In some embodiments, the inverted F metal plate 310 and the metal board 140 are integrally formed. In other words, the inverted F metal plate 310 may be a portion of the metal board 140, and is formed by reversely folding the metal board 140 in the Y direction.

In some embodiments, the inverted F metal plate 310 includes a first portion 311 extending in the −Y direction, a second portion 312 extending in the +Z direction, and a third portion 313 extending in the −Y direction. The antenna unit 260 is disposed between the first portion 311 and the third portion 313 of the inverted F metal plate 310, and the metal board 140 is disposed perpendicular to the second portion 312 of the inverted F metal plate 310. In some embodiments, the length of the first portion 311 of the inverted F metal plate 310 in the Y direction is defined as a distance d14, the length of the second portion 312 of the inverted F metal plate 310 in the Z direction is defined as a distance d11, the length of the third portion 313 of the inverted F metal plate 310 in the Y direction is defined as a distance d15, and the length of the third portion 313 of the inverted F metal plate 310 in the Z direction is defined as a distance d18. The distance d14 may be 4.35 mm, the distance d11 may be 3.85 mm, the distance d15 may be 2.3 mm, and the distance d18 may be 0.6 mm, but the disclosure is not limited thereto.

In some embodiment, at least one coupling gap is provided between the antenna unit 260 and the inverted F metal plate 310. Specifically, a spacing distance d12 is provided between the antenna unit 260 and the second portion 312 of the inverted F metal plate 310, and a spacing distance d13 is provided between the antenna unit 260 and the third portion 313 of the inverted F metal plate 310. The distance d12 may be 0.71 mm, and the distance d13 may be 0.76 mm, but the disclosure is not limited thereto. Any coupling gap (i.e., the distance d12 and the distance d13) greater than 0.5 mm falls within the scope of the disclosure.

In some embodiments, the insulating board 330 includes a protruding part 331 and a main body 332. The protruding part 331 is matched with the slot 111 and has a spacing distance d22 with respect to the slot 111. The distance d22 may be 0.2 mm, but the disclosure is not limited thereto. The main body 332 of the insulating board 330 and the antenna unit 260 are disposed side by side, and one end of the main body 332 of the insulating board 330 and one end of the antenna unit 260 are disposed between the first portion 311 and the third portion 313 of the inverted F metal plate 310. The respective other ends of the main body 332 of the insulating board 330 and the antenna unit 260 are disposed between the metal board 140 and the signal transmission line 230.

In some embodiments, the insulating board 330 may be realized with plastics. The length of the insulating board 330 in the Z direction is defined as a distance d16, and the distance d16 is in a range from 0.5 mm to 0.6 mm.

In some embodiments, as shown in FIG. 3, the length of the antenna unit 260 in the Z direction is defined as a distance d17, and the overlapped length of the antenna unit 260 and the insulating board 330 with the metal board 140 in the Y direction is defined as a distance d19. The distance d17 may be 0.4 mm, and the distance d19 may be 2 mm.

In some embodiments, as shown in FIG. 3, the length of the screen 130 in the Z direction is defined as a distance d21, and the length of the signal transmission line 230 in the Z direction is defined as a distance d20. The distance d21 may be 0.55 mm, and the distance d20 is in a range of being less than 1.5 mm.

Figure 4:
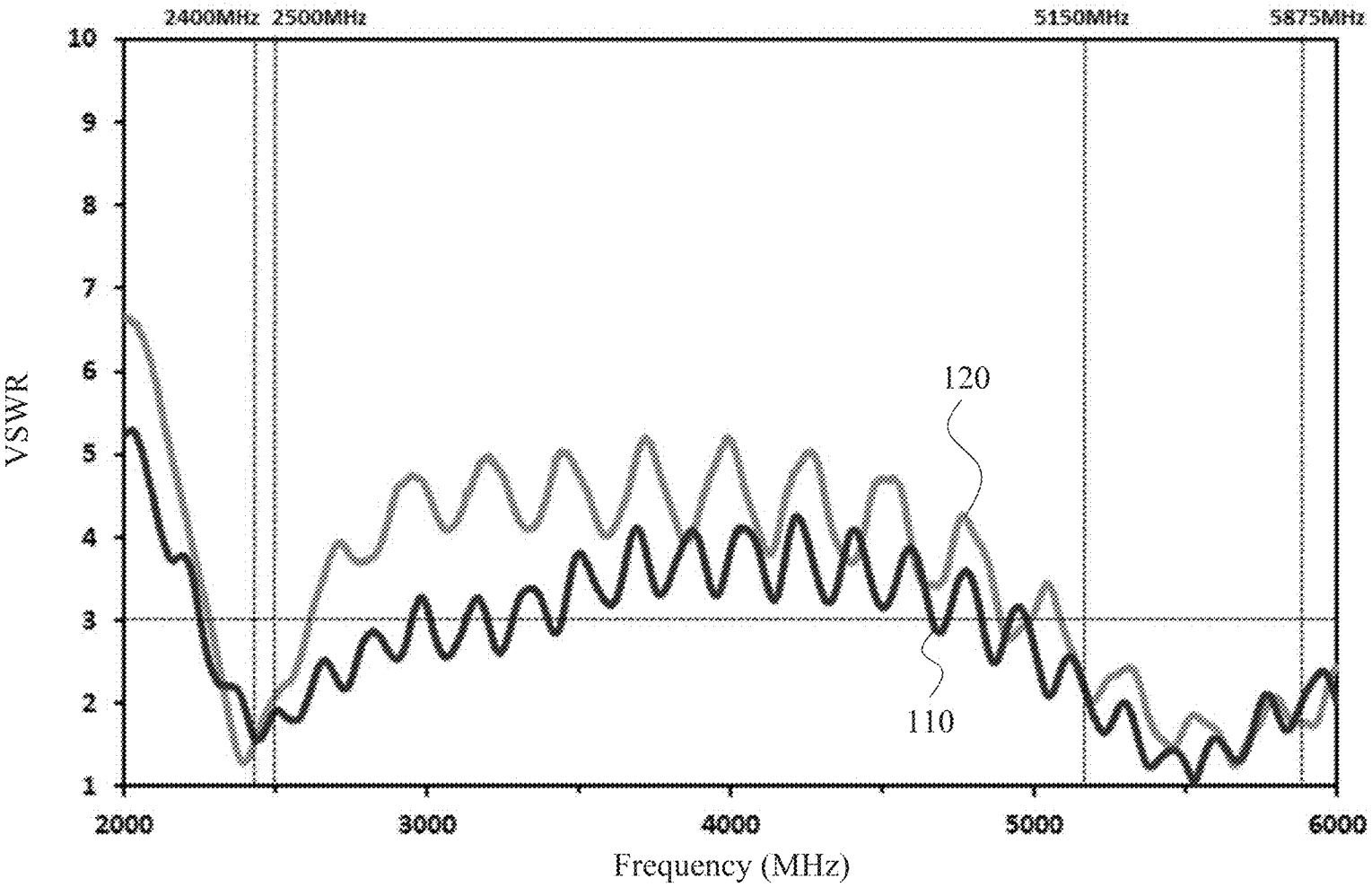
FIG. 4 is an experimental data diagram of an antenna module according to some embodiments of the disclosure.

FIG. 4 is an experimental data diagram of the antenna modules 110 and 120 according to some embodiments of the disclosure. As shown in FIG. 4, the voltage standing wave ratios (VSWR) of the antenna modules 110 and 120 disposed in the disclosure are all less than 3 within the frequency range from 2400 MHz to 2500 MHz and the frequency range from 5000 MHz to 6000 MHz. In other words, with the configuration of the disclosure, the antenna modules 110 and 120 have favorable matching.

Figure 5:
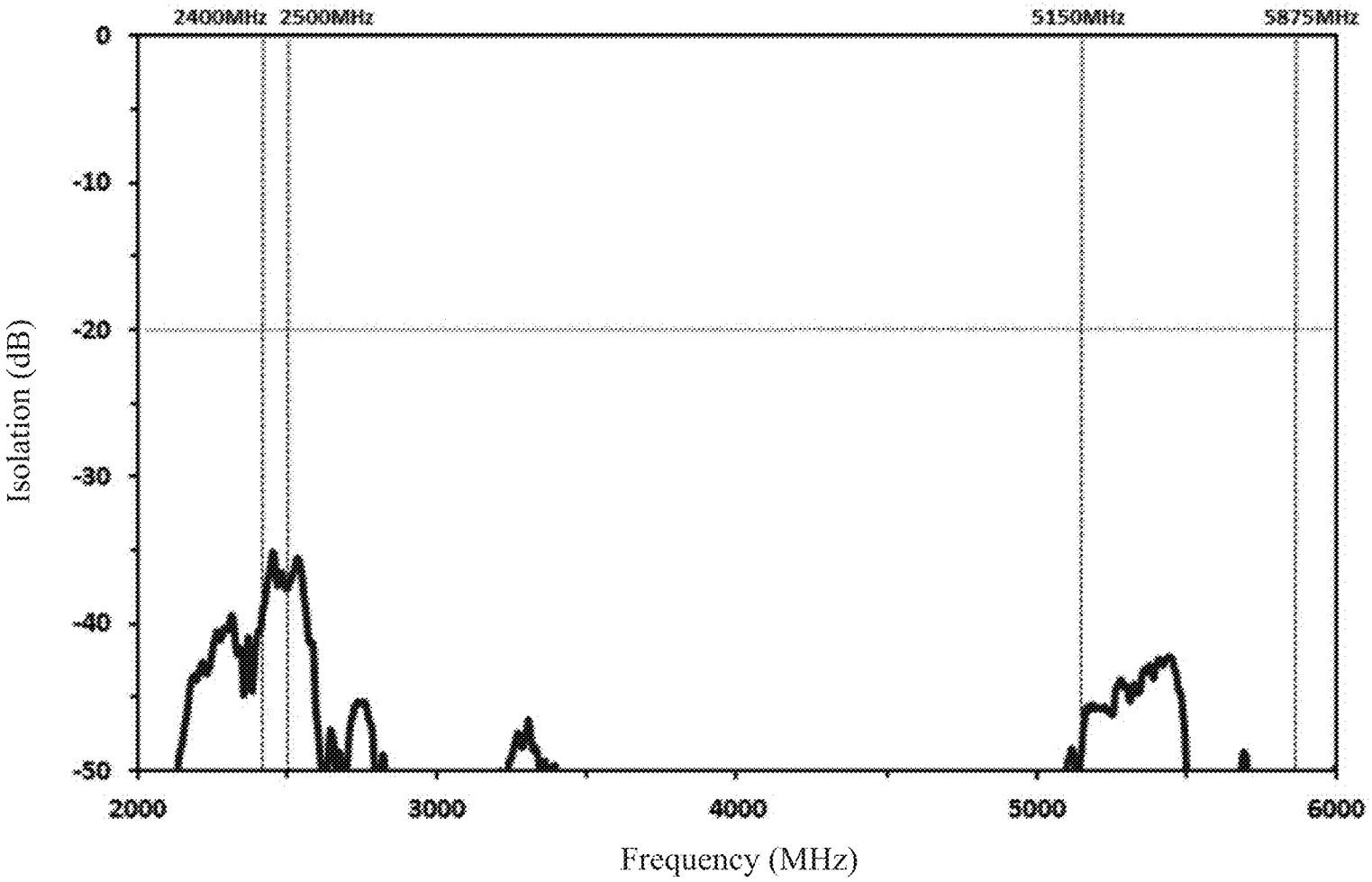
FIG. 5 is an experimental data diagram of an antenna module according to some embodiments of the disclosure.

FIG. 5 is an experimental data diagram of the antenna modules 110 and 120 according to some embodiments of the disclosure. The experimental data diagram is an experimental data diagram of frequency-isolation S21 measured by a network analyzer. According to the experimental data diagram of FIG. 5, within a frequency range from 2400 MHz to 2500 MHz, the reflection loss of the antenna module 110 and the antenna module 120 is about −37 dB, and within a frequency range from 5000 MHz to 6000 MHz, the reflection loss of the antenna module 110 and the antenna module 120 is less than −40 dB. In other words, since the spacing distance between the antenna module 110 and the antenna module 120 of the disclosure is designed to be greater than 12 cm, isolation far lower than the standard of −20 dB can be achieved.

Figure 6:
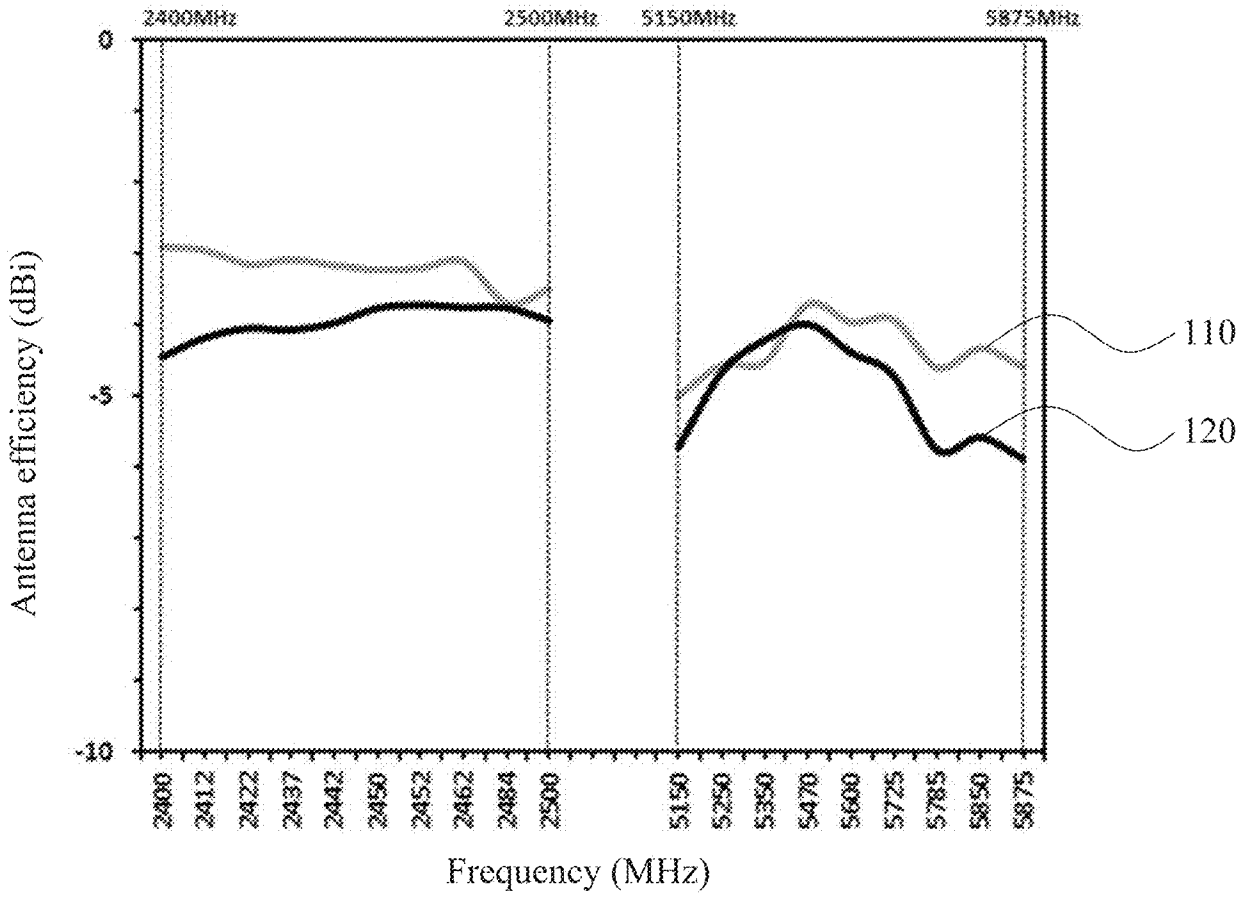
FIG. 6 is an experimental data diagram of an antenna module according to some embodiments of the disclosure.

FIG. 6 is an experimental data diagram of the antenna modules 110 and 120 according to some embodiments of the disclosure. According to FIG. 6, within a frequency range from 2400 MHz to 2500 MHz, the antenna efficiency of the antenna modules 110 and 120 is from −2.9 dBi to −4.4 dBi, and within a frequency from 5000 MHz to 6000 MHz, the antenna efficiency of the antenna modules 110 and 120 is from −3.7 dBi to −5.9 dBi. In other words, even if the antenna modules 110 and 120 are disposed in a narrow metal frame, the antenna efficiency is still high.

In view of the foregoing, the dual frequency antenna design with dual open-loop for a narrow metal frame is provided in the embodiments of the disclosure by cooperative operation of the inverted F metal plate 310 additionally disposed on the narrow frame with the pattern on the antenna unit 260 as well as adjustment of the antenna impedance matching through inverted U grounding configuration.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. An antenna module, comprising:

a metal board;

an inverted F metal plate, wherein a slot is provided between the inverted F metal plate and the metal board, the inverted F metal plate and the metal board are integrally formed, and the inverted F metal plate is disposed perpendicular to the metal board;

an antenna unit, disposed in correspondence with the slot and the inverted F metal plate, and the antenna unit comprising a radiation part and a ground part, wherein the radiation part is coupled to a signal feeding point and comprises a first radiation body and a second radiation body, and the first radiation body, the slot, and the inverted F metal plate operate cooperatively to generate a wireless signal at a first operating frequency, and the second radiation body, the slot, and the inverted F metal plate operate cooperatively to generate a wireless signal at a second operating frequency; and a signal transmission line, wherein a positive end of the signal transmission line is coupled to the signal feeding point, and a negative end of the signal transmission line is grounded through a first metal conductor, wherein an end of the ground part is grounded through a second metal conductor, the ground part and the signal transmission line are connected in a first direction, the second metal conductor extends from the end of the ground part along a second direction, the first metal conductor extends from the signal transmission line along the second direction, the first metal conductor and the second metal conductor are spaced apart in the first direction, and the first direction is perpendicular to the second direction.

2. The antenna module as claimed in claim 1, wherein the inverted F metal plate comprises a first portion extending in the first direction, a second portion extending in the second direction, and a third portion extending in the first direction, and the metal board is disposed perpendicular to the second portion of the inverted F metal plate.

3. The antenna module as claimed in claim 1, wherein impedance matching of the first operating frequency and the second operating frequency is related to an area of the first radiation body, an area of the second radiation body, and a gap between the first metal conductor and the second metal conductor.

4. The antenna module as claimed in claim 1, wherein a gap between the first metal conductor and the second metal conductor is from 5 mm to 10 mm.

5. The antenna module as claimed in claim 1, wherein the first radiation body forms a first electrical path through at least one coupling gap between the first radiation body and the inverted F metal plate and a first portion of the slot adjacent to the first radiation body, and the second radiation body forms a second electrical path through the at least one coupling gap and a second portion of the slot adjacent to the second radiation body, and a length of the first electrical path is 0.5-0.75 times of a wavelength of the first operating frequency, and a length of the second electrical path is 0.5-0.75 times of a wavelength of the second operating frequency.

6. The antenna module as claimed in claim 5, wherein the at least one coupling gap is greater than 0.5 mm.

7. The antenna module as claimed in claim 1, wherein the inverted F metal plate comprises a first portion extending in the first direction, a second portion extending in the second direction, and a third portion extending in the first direction, wherein the antenna unit is disposed between the first portion and the third portion.

8. The antenna module as claimed in claim 7, wherein an end of the antenna unit and an end of an insulating board disposed side-by-side with the antenna unit are disposed between the first portion and the third portion of the inverted F metal plate.

9. A communication device, comprising:

a metal board;

an inverted F metal plate, wherein a first slot and a second slot are provided between the inverted F metal plate and the metal board, respectively, the inverted F metal plate and the metal board are integrally formed, and the inverted F metal plate is disposed perpendicular to the metal plate;

a first antenna unit, disposed in correspondence with the first slot and the inverted F metal plate;

a second antenna unit, disposed in correspondence with the second slot and the inverted F metal plate, the second antenna unit having a gap with respect to the first antenna unit, wherein each of the first antenna unit and the second antenna unit comprises a radiation part and a ground part, wherein the radiation part is coupled to a signal feeding point and comprises a first radiation body and a second radiation body; and a signal transmission line, wherein a positive end of the signal transmission line is coupled to the signal feeding point, and a negative end of the signal transmission line is grounded through a first metal conductor, wherein an end of the ground part is grounded through a second metal conductor, the ground part and the signal transmission line are connected in a first direction, the second metal conductor extends from the end of the ground part along a second direction, the first metal conductor extends from the signal transmission line along the second direction, the first metal conductor and the second metal conductor are spaced apart in the first direction, and the first direction is perpendicular to the second direction, and wherein the first radiation body of the first antenna unit, the first slot, and the inverted F metal plate operate cooperatively to generate a wireless signal at a first operating frequency; the second radiation body of the first antenna unit, the first slot, and the inverted F metal plate operate cooperatively to generate a wireless signal at a second operating frequency; the first radiation body of the second antenna unit, the second slot, and the inverted F metal plate operate cooperatively to generate a wireless signal at the first operating frequency; and the second radiation body of the second antenna unit, the second slot, and the inverted F metal plate operate cooperatively to generate a wireless signal at the second operating frequency.

10. The communication device as claimed in claim 9, wherein the gap between the first antenna unit and the second antenna unit is greater than 12 cm.

* * * * *